United States Patent [19]

Allen et al.

[11] Patent Number: 4,956,666

[45] Date of Patent: Sep. 11, 1990

[54] SECURE COPIER AND METHOD OF REPRODUCTION

[75] Inventors: James D. Allen, Greece; Calviin E. Harris, Fairport; Debora M. Litwiller, Greece; Matthew J. Russel, Mendon, all of N.Y.

[73] Assignee: Eastman Kodak Company, Rochester, N.Y.

[21] Appl. No.: 365,327

[22] Filed: Jun. 13, 1989

[51] Int. Cl.[5] ..... G03G 21/00

[52] U.S. Cl. ..... 355/201; 355/133; 355/202; 355/203

[58] Field of Search ..... 355/201, 202, 203, 204, 355/206, 133, 230, 311; 283/901, 902; 235/435, 439, 444, 449; 356/71

[56] References Cited

U.S. PATENT DOCUMENTS

| | | | |
|---|---|---|---|
| 2,547,838 | 4/1951 | Russell . | |
| 3,676,644 | 7/1972 | Vaccaro et al. . | |
| 4,180,207 | 12/1979 | Lee . | |
| 4,313,087 | 1/1982 | Weitzen et al. . | |
| 4,446,204 | 5/1984 | Kaule et al. | 356/71 X |
| 4,453,821 | 6/1984 | Smith | 355/204 X |
| 4,455,039 | 6/1984 | Weitzen et al. . | |
| 4,486,090 | 12/1984 | Warhol | 355/133 X |
| 4,586,811 | 5/1986 | Kubo et al. | 355/133 X |
| 4,603,970 | 8/1986 | Aota et al. | 355/133 |
| 4,675,669 | 6/1987 | Goldman . | |
| 4,678,322 | 7/1987 | Finkel et al. | 355/133 |
| 4,739,377 | 4/1988 | Allen | 355/133 |
| 4,777,510 | 10/1988 | Russel . | |
| 4,794,421 | 12/1988 | Stoudt et al. | 355/202 |

FOREIGN PATENT DOCUMENTS

| | | | |
|---|---|---|---|
| 3132644 | 10/1982 | Fed. Rep. of Germany . | |
| 61-255362 | 11/1986 | Japan . | |
| 61-258278 | 11/1986 | Japan . | |
| 8501128 | 3/1985 | World Int. Prop. O. | 355/201 |
| 8501129 | 3/1985 | World Int. Prop. O. | 355/201 |

OTHER PUBLICATIONS

IBM Technical Disclosure Bulletin, vol. 15, No. 7, Dec. 1972, p. 2328, Marinace, J. C., "Copier System for Confidential Papers".

IBM Technical Disclosure Bulletin, vol. 15, No. 9, pp. 2736–2737, Feb. 1973.

IBM Technical Disclosure Bulletin, vol. 15, No. 12, p. 3642, May 1973.

IBM Technical Disclosure Bulletin, vol. 16, No. 6, pp. 1951–1952, Nov. 1973.

IBM Technical Disclosure Bulletin, vol. 17, No. 11, p. 3182, Apr. 1975.

IBM Technical Disclosure Bulletin, vol. 17, No. 11, pp. 3198–3199, Apr. 1975.

IBM Technical Disclosure Bulletin, vol. 18, No. 4, p. 1002, Sep. 1975.

*Primary Examiner*—A. T. Grimley
*Assistant Examiner*—Matthew S. Smith
*Attorney, Agent, or Firm*—Norman Rushefsky

[57] ABSTRACT

A highly productive copier for use in a secure area or building is described. The copier includes a transparent electrical coil mounted either upon or within the copier's exposure platen and accompanying circuitry coupled thereto for detecting the proximity of metal such as those having magnetic or ferromagnetic properties. A document sheet fed to the platen for copying is sensed for the presence of the metal. Metal is present in confidential documents that have been made with metal containing toners and which are to be copied only by those authorized for copying same. A user identification system is provided for allowing users to identify themselves to the machine for allowing copying of confidential documents. Nonconfidential documents may be copied without requirement of identification. The copier is highly productive because it may be used with known high speed document feeders such as recirculating feeders without requiring a waiting period for the coil to be moved relative to the document. Copies made from the copier are reproduced either with metal containing toners for confidential documents or non-metal containing toners for non-confidential documents. A reproduction mode is also provided for allowing reproduction of documents not containing metal into copies which contain metal to create a detectable confidential document.

10 Claims, 5 Drawing Sheets

SECURE COPIER AND METHOD OF REPRODUCTION

CROSS REFERENCE TO RELATED APPLICATIONS

This application is related to U.S. Ser. No. 365,590, filed June 13, 1989 on even date herewith in the names of James E. Allen et al and entitled "Copier/Printer and Method for Reproduction of Secure Documents or the Like."

FIELD OF THE INVENTION

The present invention relates to method and apparatus for controlling the copying of confidential documents. More particularly, the present invention relates to method and apparatus for permitting copying of non-confidential documents but limiting copying of confidential documents, formed for example with metal toners, to those authorized to copy same.

BACKGROUND OF THE INVENTION

In the office environment numerous documents are generated for which copies are required from time to time but yet copying of same is desired to be limited. For example, some employees may be granted temporary access to certain confidential documents but they are not permitted to make copies of them. Other employees in this office may have authorization to make copies of these confidential documents. It would therefore be desirable to provide a copier with the ability to determine if a document is confidential and limit access to copying to those authorized to copy same yet allow copying of non-confidential documents.

In the prior art as represented by U.S. Pat. No. 4,603,970, it is recognized that confidential documents may be distinguished by providing them with a metal so that copying of the confidential documents can be inhibited. In order to detect a confidential document a proximity detector is provided that moves relative to the document. A problem with such a copier is that productivity is lowered due to waiting time required for the proximity detector to traverse its fixed course so as to scan the entire document for any metal. Although it is recognized that the detector can remain stationary in those copiers using a document supporting platen glass that moves, such copiers are also relatively low in productivity.

It is, therefore, an object of the invention to provide a secure copier with relatively higher productivity capabilities than that suggested by the above prior art

SUMMARY OF THE INVENTION

The above and other objects are accomplished by reproduction apparatus for controlling reproduction of confidential documents, the apparatus comprising:

- a transparent platen for supporting a document for exposure;
- a photosensitive means for forming an image of the document;
- means for developing the image to form a reproduction; and characterized by:
- a transparent coil formed upon the platen;
- means for energizing the coil with a varying electrical signal; and
- means responsive to a signal from the coil to detect the presence of a substance in the document affecting the magnetic field of the coil to determine whether or not the document is a confidential document.

The above and other objects are further accomplished by a method for controlling reproduction of confidential documents, the method comprising the steps of:

- placing a document containing an image formed using a marking medium containing a metal upon a document exposure platen;
- the platen including a transparent coil formed thereon;
- energizing the coil with a varying electrical signal; and
- in response to a signal from the coil indicating the presence of metal in the document, providing a signal to inhibit copying.

DESCRIPTION OF THE PREFERRED EMBODIMENT

Figure 1:
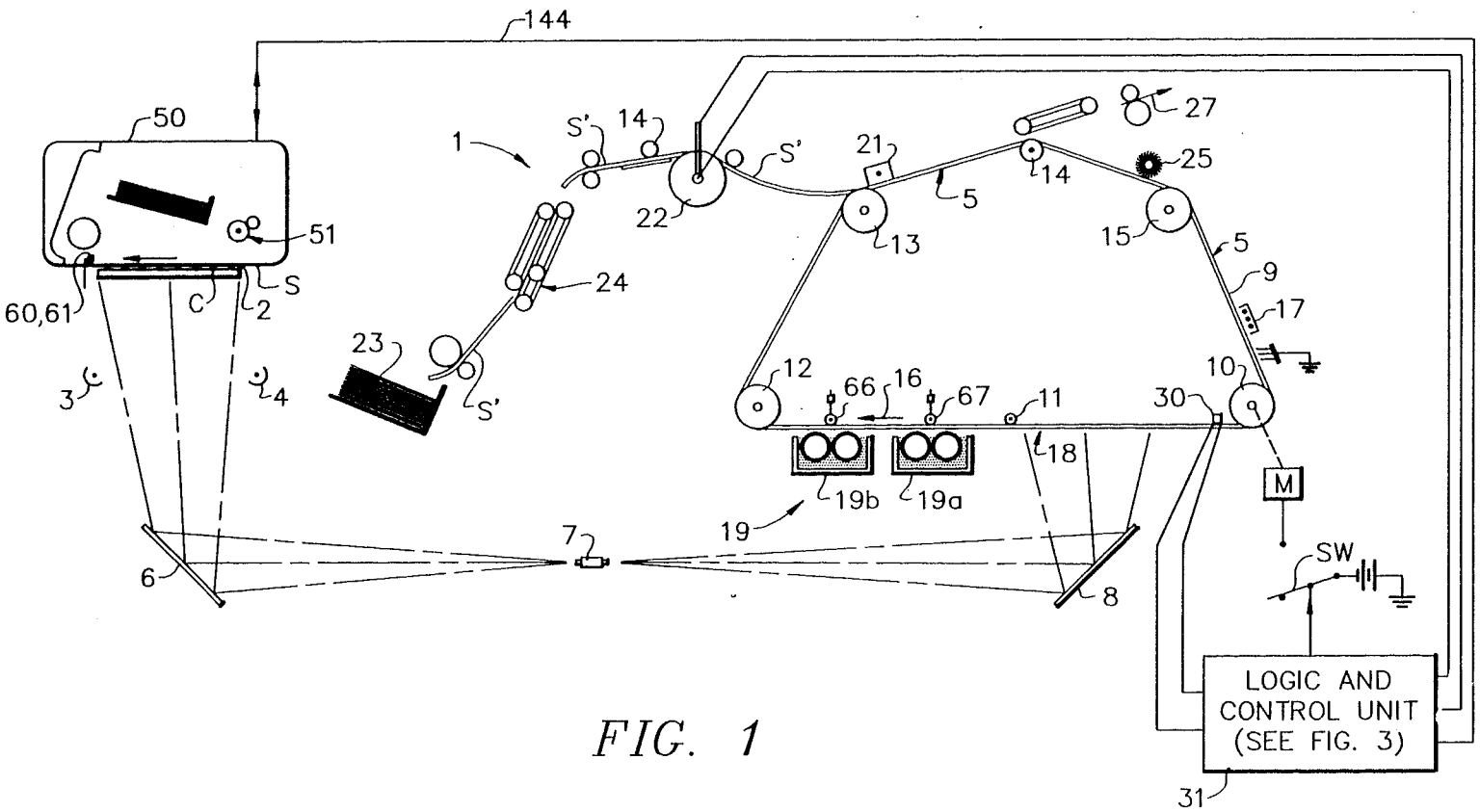
FIG. 1 is a schematic of an elevational view of a copier made in accordance with the teachings of the invention.

To assist in understanding the present invention, it will be useful to consider an apparatus which includes an electrophotographic copier, a logic and control unit and a recirculating feeder. At the outset, it will be noted that although this invention is suitable for use with recirculating feeders, it can also be used with other document feeders. Whenever the term "document" is used, it refers to a particular document of an original document set having one or more documents. The term "copy sheet" refers to a sheet with a fixed image which is produced by a copier.

A recirculating feeder 50 is positioned on top of exposure platen 2. The recirculating feeder may be similar to that disclosed in commonly assigned U.S. Pat. No. 4,076,408, issued Feb. 28, 1979 wherein a plurality of documents having images only on first sides of the documents can be repeatedly fed in succession from a document stack or set to an exposure platen 2 of copier 1. Alternatively, feeders for feeding duplexed documents and copies for copying same may also be used.

The feeder 50 includes feed rollers 51 which transport a document S across the exposure platen 2 of the copier 1. The platen 2 is constructed of transparent glass. When energized, two xenon flash lamps 3 and 4 flash illuminate the moving document S. For a specific disclosure of an illumination arrangement, see commonly assigned U.S. Pat. No. 3,998,541, issued Dec. 31, 1976. Sensors 60 and 61 are disposed adjacent to the downstream edge of the platen 2. For a specific example of one kind of edge sensor (e.g. photocell) that can be used, see commonly assigned U.S. Pat. No. 3,660,670. When the leading edge of document S covers these sensors, they provide signals to a logic and control unit (LCU) 31 which determines the time of flash. By means of an object mirror 6, lens-shutter system 7 and an image mirror 8, an image of the illuminated document is optically stopped on discrete image areas of a moving imaqe forming member. The disclosed image forming member is a photoconductor shown as a photoconductive web 5.

The photoconductive web 5 includes a photoconductive layer with a conductive backing on a polyester support. The web 5 is trained about six transport rollers 10, 11, 12, 13, 14 and 15, thereby forming an endless or continuous belt. Roller 10 is coupled to a drive motor M in a conventional manner. Motor M is connected to a source of potential V when a switch SW is closed by the logic and control unit (LCU) 31. When the switch SW is closed, the roller 10 is driven by the motor M and moves the web 5 in a clockwise direction indicated by arrow 16. This movement causes successive image areas of the web 5 to sequentially pass a series of electrophotographic work stations of the copier.

The several copier work stations along the web's path of movement include:

- a charging station 17 at which the photoconductive surface 9 of the web 5 is sensitized by receiving a uniform electrostatic charge;
- an exposing station 18 at which the inverse image of the document S is projected onto the photoconductive surface 9 of the web 5; the image dissipates the electrostatic charge at the exposed areas of the photoconductive surface 9 and forms a latent electrostatic image on surface 9;
- a magnetic brush developing station 19 at which developing powder, including electroscopic toner particles having an electrostatic charge opposite that of the latent electrostatic image, is brushed over the photoconductive surface 9 of the web 5; this causes the toner particles to adhere to the latent electrostatic image to form a visible toner particle, transferable image resembling the document S;
- a transfer station shown as a corona charger 21, at which the toner image on web 5 is transferred to a copy sheet S' by electrostatic transfer means; and
- a copy sheet feeding station 24 for feeding from supply 23 copy sheets S' seriatim into register with each image frame at the transfer station such as described in U.S. Pat. No. 4,310,236;
- a cleaning station 25 at which the photoconductive surface 9 of the web 5 is cleaned of any residual toner particles remaining thereon after the transfer images have been transferred and is discharged of any residual electrostatic charge remaining thereon.

After transfer of the unfixed electroscopic images to a copy sheet S', it is transported to fuser 27 where the transferred toner particles forming the image are fused to the copy sheet.

To coordinate operation of the various work stations 17, 18, 19, 21 and 25 with movement of the image areas on the web 5 past these stations, the web has a plurality of perforations along one of its edges. These perforations generally are spaced equidistantly along the edge of the web member 5. For example, the web member 5 may be divided into six image areas by F perforations; and each image area may be subdivided into 51 sections by C perforations. The relationship of the F and C perforations to the image areas is disclosed in more detail in commonly assigned U.S. Pat. No. 3,914,047. At a fixed location along the path of web movement, there is provided suitable means 30 for sensing F and C web perforations. This sensing produces input signals into a LCU 31 having a digital computer. The digital computer has a stored program responsive to the input signals for sequentially actuating, then deactuating the work stations as well as for controlling the operation of many other machine functions as disclosed in U.S. Pat. No. 3,914,047.

Programming of a number of commercially available minicomputers or microprocessors such as an INTEL model 8080 or model 8086 microprocessor (which along with others can be used in accordance with the invention), is a conventional skill well understood in the art. The following disclosure is written to enable a programmer having ordinary skill in the art to produce an appropriate program for the computer. The particular details of any such program would, of course, depend upon the architecture of the selected computer.

Figure 3:
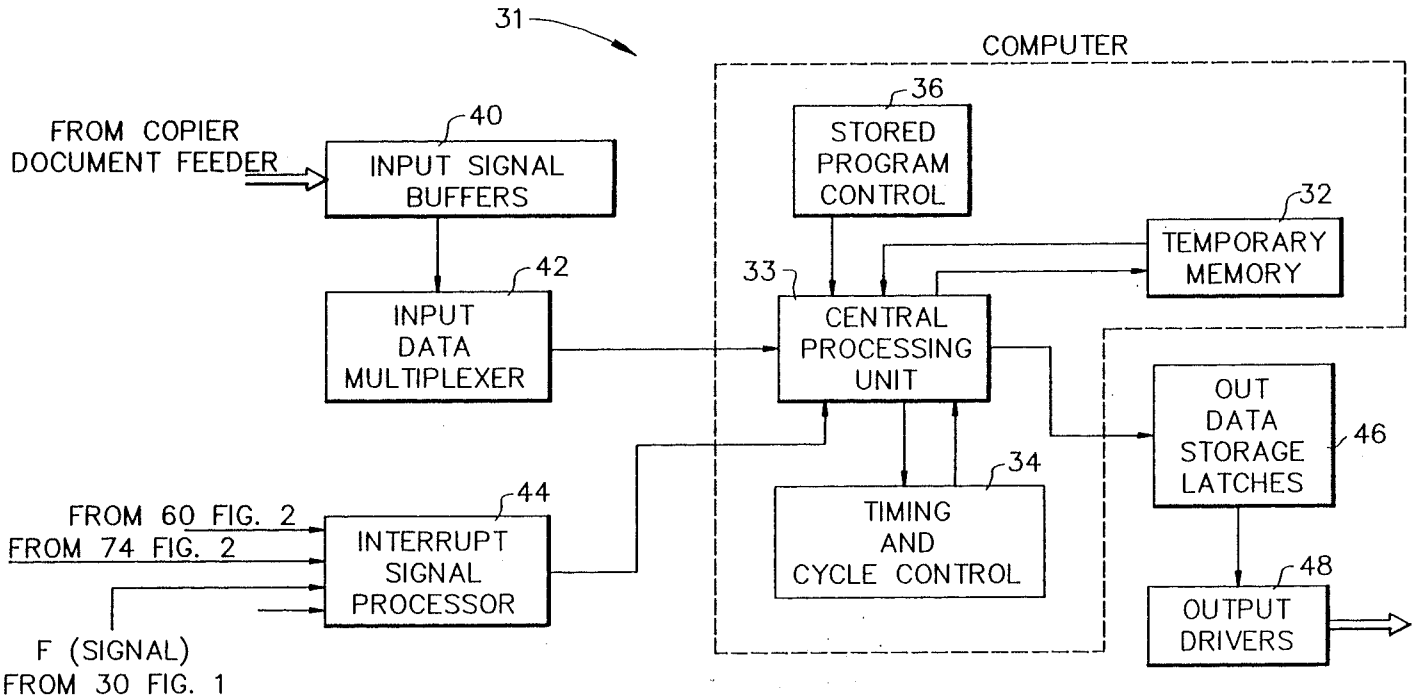
FIG. 3 is a schematic of a logic and control unit for the apparatus of FIG. 1.

Turning now to FIG. 3, a block diagram of a typical logic and control unit (LCU) 31 is shown which interfaces with the copier 1 and the feeder 50. The feeder 50 is also controlled by LCU 31. Leads 144 from feeder 50 provide inputs to and receive outputs from LCU 31 to synchronize the operation of the feeder. For a more detailed disclosure see commonly assigned U.S. Pat. No. 4,078,787. The LCU 31 consists of temporary data storage memory 32, central processing unit 33, timing and cycle control unit 34, and stored program control 36. Data input and output is performed sequentially under program control. Input data is applied either through input signal buffer 40 to a multiplexer 42 or to interrupt signal processor 44. The input signals are derived from various switches sensors, and analog-to-digital converters. The output data and control signals are applied to storage latches 46 which provide inputs to suitable output drivers 48, directly coupled to leads. These leads are connected to the work stations.

The time sequence of machine control signals (often referred to in the art as events) is critical to the copy cycle because the copier and feeder and associated mechanisms must be powered ON and OFF in the correct sequence to assure high quality copying and to prevent paper misfeeds, misregistration and erratic operation. One way of controlling the time sequence of events and their relationship to each other is, as noted above, to sense perforations which have a fixed positional relationship to the image areas on the web 5 as these areas continue through a copier. Thus, the detection of perforations by a sensor 30 is applied to the LCU 31 through the interrupt signal processor 44 (see FIG. 3) and is used to synchronize the various control mechanisms with the location of the image areas.

Returning now to the computer, the program is located in stored program control 36 which may be provided by one or more conventional Read Only Memories (ROM). The ROM contains the operational program in the form of binary words corresponding to instructions and numbers. These programs are permanently stored in the ROM and cannot be altered by the computer operation.

Typically, the ROM is programmed at the manufacturer's facility to provide the required control functions such as work station sequential control, jam recovery, and operator observable messages The ROM also has the required instructions controlling the operation of the mechanism 22.

The temporary storage memory 32 may be conveniently provided by a conventional Read/Write memory or Random Access Memory (RAM).

Figure 2:
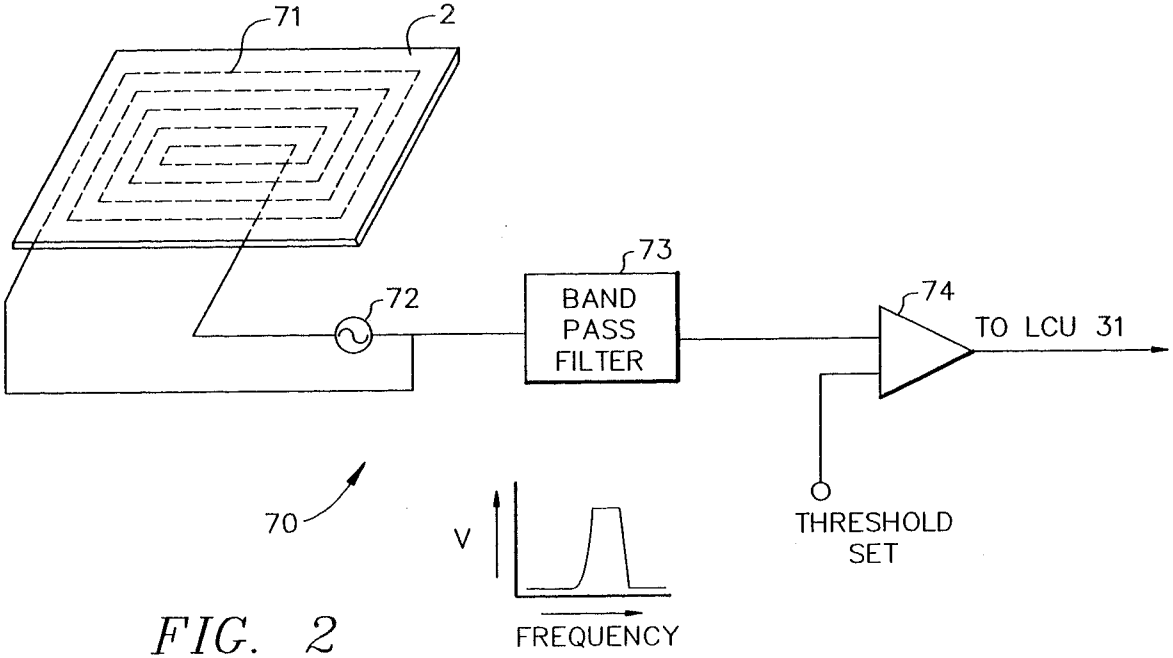
FIG. 2 is a schematic of the platen glass in the copier of FIG. 1, the glass incorporating a coil and also illustrating a schematic of an electrical circuit for use in detecting metal in a document supported on the glass.

With reference now to FIG. 2, the platen glass 2 is shown to include a coil that is electrically conductive and is attached to the underside of the platen. The coil must be sufficiently transparent so as not to affect adversely image formation by the copier. One known material suitable for use is indium tin oxide. Other materials such as metallic semiconductors films may also be used. Attachment of the coil to the underside of the platen protects against wear and deliberate destruction. However, the coil may be placed on the operator accessible (external) surface of the platen and prevented from wear by placement of a transparent diamond coating over the coil with a transparent electrically insulating layer between diamond coating and coil. The location of the coil on the external platen surface contacted by the document provides for increased sensitivity, as there is no glass separating the detector from the metal containing document. Alternatively, the coil may be embedded within the transparent platen or located off the platen altogether but still in the exposure path. With the coil located off the platen and beneath the exposure glass it may be placed at a position of defocus relative to that of the document so as to minimize optical degradation of the image. However, the coil still must be close enough to the document to sense the presence of the metal in same.

Figure 4:
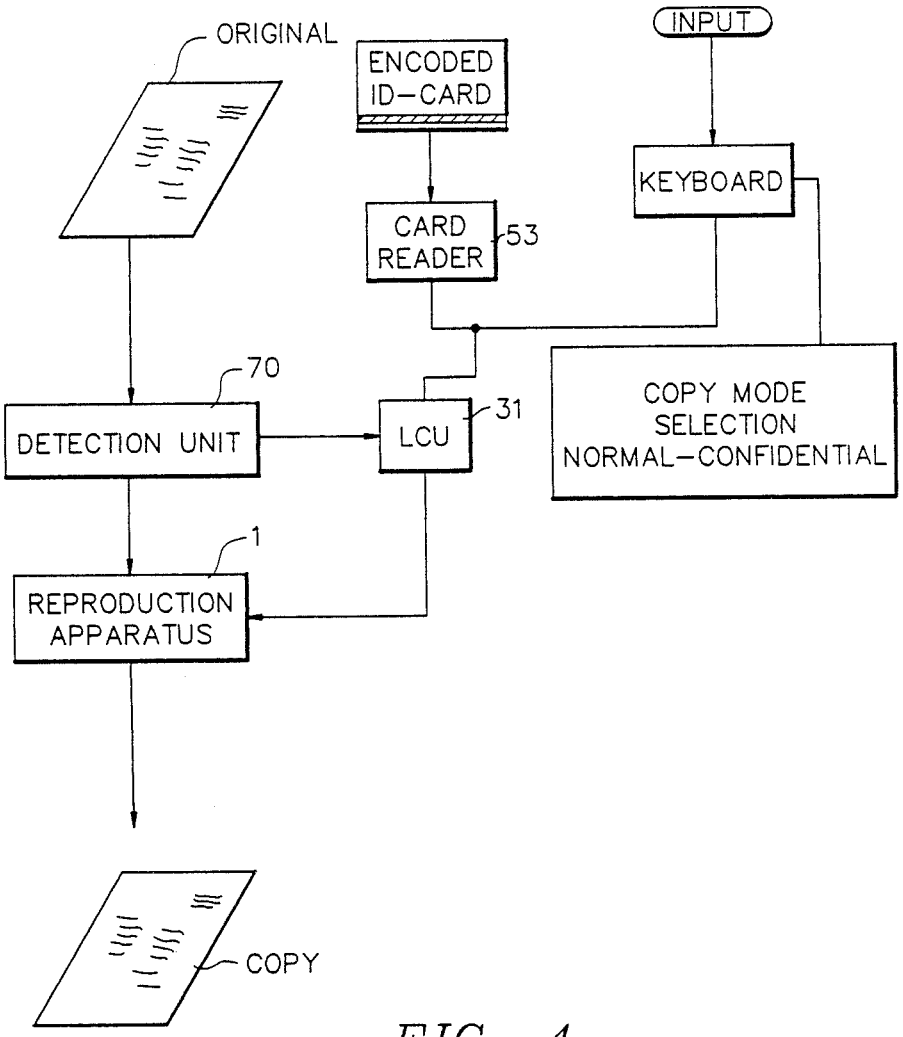
FIG. 4 is a schematic of an authorization system for use with the apparatus of the invention.
Figure 5:
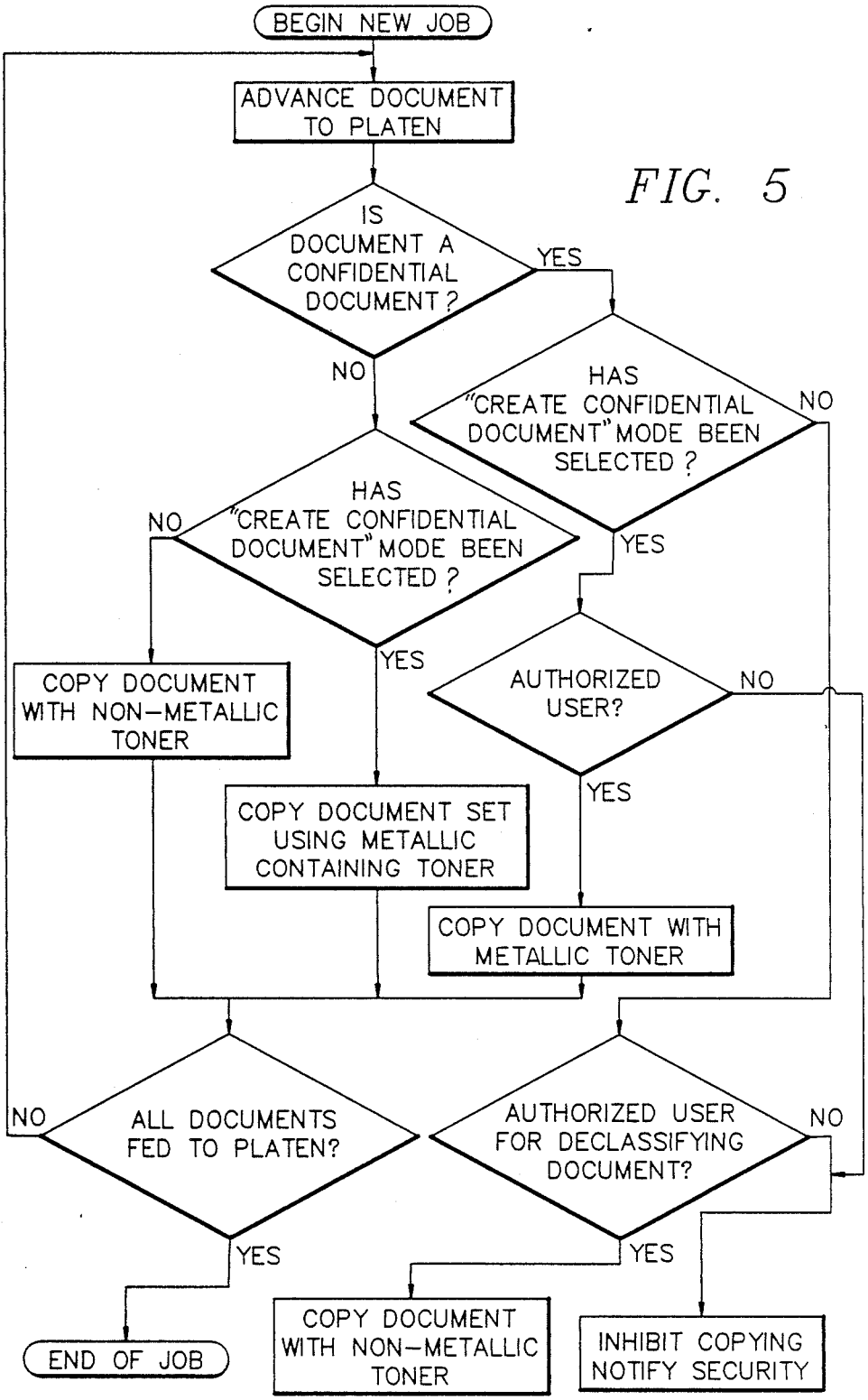
FIG. 5 is a flow chart illustrating the program of steps undertaken by the apparatus and method of the invention.

It is preferred that the confidential documents to be copied include a metallic ink used for the printing of the information therein. Suitable metals as the term is used herein comprise those having magnetic or ferro magnetic properties or properties otherwise detectable by affecting the magnetic field created by the coil. The apparatus described herein however permits an original document to be made using non-metallic ink and reproduction of same to produce a document that can be detected to prevent future unauthorized reproductions. With reference now also to FIGS. 4 and 5, assume that an original confidential document is prepared using a non-metallic ink. In order to ensure that copies cannot be made of same within the office or building holding same, all copiers are provided with a detection unit as described herein. The confidential document may comprise a multi-sheet document set and is placed in a recirculating feeder 50. The authorized operator then selects a "create confidential document" reproduction mode by selecting an appropriate button on the copier's operator control panel or keyboard. In this mode, all reproductions are made using toning station **19*b* and no reproductions are made if the original is detected to have metallic content. Toning station 19*b* is provided with a toner called MICR which is a known metal containing toner used for producing bank checks or the like so that the information thereon can be read by magnetic readers. Document reproduction is made by feeding the documents seriatim to the exposure platen, exposing each one in turn to a respective image frame on web 5 and actuating development using MICR station 19*b* with MICR toner by, for example, selective activation of a back-up roller 66 which alters the path of web 5 into engagement with the toner of station 19*b*. The toned image frame is then transferred to a copy sheet S' as indicated above and the image fixed by fuser rollers 27**. The document set reproduction now produced is capable of being detected by the detection apparatus of the invention as will be described and the original may now be destroyed.

Assume now that someone wishes to copy a confidential document that has metallic content. The document set to be reproduced is placed in the recirculating feeder. He/she then verifies authorization to make copies of confidential documents by placing his/her card in the card reader 53 and inputting the personal identification code via the keyboard that also forms a part of the copier. The normal copy mode is then selected by the operator or operates automatically as a default in the event a copy start button (not shown) is pressed. The inputs from the card reader and the keyboard are compared by the LCU 31 and a decision is made as to whether or not this individual is authorized to copy confidential documents. If this decision is no, the copy sheets are fed seriatim to the exposure platen. For each document the presence of a metal therein will be sensed by the detection circuit 70. As may be noted in FIG. 2, a detection circuit includes, in addition to the coil 71, a source of alternating current 72 to the coil and a sharp crystal band pass filter 73. The presence of metal in the document alters the frequency of the circuit. The band pass filter is set so that it will attenuate signals with frequencies produced for documents not containing metal but will pass signals at frequencies produced by metal containing documents. A Schmitt trigger 74 is then provided to detect if the signal level has exceeded a fixed threshold required for confidential documents and the output of Schmitt trigger will be at one level to indicate that the document has metallic content and will be at a different level to indicate that the document does not have metallic content. The output of Schmitt trigger is fed to LCU 31 via interrupt signal processor 44 which determines the nature of the document and whether or not the person requesting the copy is authorized to reproduce same. If the document is confidential and the requester authorized, a copy is made using station **19*b* containing MICR toner. If the requester is not authorized, no copy of that document is made and the next document is fed to the platen. A log may be kept by the LCU of all attempts to copy confidential documents by unauthorized users. This document, if confidential, also will not be copied. If, however, this document is not confidential (no metallic content), it will be copied using toning station 19*a* which includes non-metallic toner. In this regard, back-up roller 67 is actuated to move the web 5 into engagement with the toner of station 19*a***. Thus, a mixed set of originals can be placed in the feeder and the apparatus will determine which documents to copy in accordance with the authorization provided to the requester.

The LCU may control this selective copying by not energizing the lamp 3, 4 and a shutter within lens 7 when authorization for copying a document is not proved during the normal mode of copying.

The apparatus of the invention is also useful when the recirculating feeder is not used such as when the feeder is raised to allow copying of documents bound in a book or single documents. These documents are placed directly on the platen for copying.

While the invention has been described with a proximity detector of one type, other types may also be operative for example those employing a "loss tangent type" which detects the angle between the real and "imaginary" components of impedance. Phase angle detectors may also be useful.

There has thus been disclosed a highly productive reproduction method and apparatus for use in controlling the reproduction of confidential documents. The invention is particularly suited for retrofit to existing copiers by modification of the platen glass and addition of an inexpensive electrical circuit and minor changes to the control program for controlling the copier.

While the invention has been described in terms of copiers where a reflection of an original is imaged upon a photoconductive material such as a web, drum or sheet, other modifications will be apparent to those skilled in the art. For example, reflections of light from the document may be imaged upon devices such as CCD's (charge coupled devices) for providing electrical signals representative of the image upon the document. These electrical signals may then be used to control various printing devices such as electro-optic printers that print using laser or light emitting diodes or control electro-optic shutter devices (liquid crystal) which can be used to modulate light upon a photoconductive member. Other printing devices such as stylus recorders may also be used to modulate charge upon a photoconductive member in response to electric signals representing image information of the document. In its broader aspects of the invention, reproduction may be accomplished using ink jet or other known printers whose use would readily be suggested by the teachings herein.

The invention has been described in detail with particular reference to preferred embodiments thereof, but it will be understood that variations and modifications can be effected within the spirit and scope of the invention.

What is claimed is:

1. A reproduction apparatus for controlling reproduction of confidential documents, the apparatus comprising:

a transparent platen for supporting a document for exposure;

means for illuminating the document so that light reflected therefrom is imaged and passes through said platen along an exposure path;

a photoconductive means located along said exposure path for forming an image of the document;

means for electrostatically charging the photoconductive material;

means for developing the image to form a reproduction, the developing means including means for developing an electrostatic image of the document with a transferable toner and for transferring the toner to a receiver sheet to form the reproduction;

a transparent coil located in the exposure path of light reflected from the document;

means for energizing the coil with a varying electrical signal;

means responsive to a signal from the coil for detecting the presence of a substance in the document affecting the magnetic field of the coil for determining whether or not the document is a confidential document; and wherein the developing means further includes two development stations and means for selectively developing the reproduction of the confidential document with a first toner containing metal and for selectively developing the reproduction of the non-confidential document with a second toner that does not contain metal;

means for enabling the reproduction of the document with the second toner if it is not identified as a confidential document and for enabling reproduction of the document with the first toner if it is identified as a confidential document; and operator identification means for enabling reproduction of confidential documents only with meeting of an authorization criterion.

2. The apparatus of claim 1 and including a feeder for feeding documents seriatim to the platen for exposure.

3. A reproduction apparatus for controlling reproduction of confidential documents, the apparatus comprising:

a transparent platen for supporting a document for exposure;

a photosensitive means for forming a latent image of the document;

means for developing the image and transferring the image to a receiver sheet to form a reproduction of the document;

a transparent coil formed upon or proximate the platen;

means for energizing the coil with a varying electrical signal; and means responsive to a signal from the coil that is generated in response to the presence of a substance in the document affecting the magnetic field of the coil to determine whether or not the document is a confidential document; and wherein the developing means includes two development stations, one of which contains a first type of toner that when transferred to a receiver sheet affects the magnetic field of the coil and the other contains a second type of toner that when transferred to a receiver sheet does not affect the magnetic field of the coil; and means for selectively developing a reproduction of the confidential document with only one of the types of toner and selectively developing a reproduction of non-confidential documents with only the other of the two types of toner, whereby confidential documents are reproduced only with one type of toner and non-confidential documents are reproduced only with the other type of toner.

4. The apparatus of claim 3 and further comprising operator identification means for enabling reproduction of confidential documents only with meeting of an authorization criterion.

5. The apparatus of claims 3 or 4 and including a feeder for feeding documents seriatim to the platen for exposure.

6. The apparatus of claims 3 or 4 and wherein the photosensitive means comprises a photoconductive material, the apparatus further including:

means for electrically charging the photoconductive material;

means for illuminating the document while the document is supported by the transparent platen; and the developing means further includes means for developing an electrostatic image of the document with a transferable toner.

7. The apparatus of claim 6 and including a feeder for feeding documents seriatim to the platen for exposure.

8. A method for controlling reproduction of confidential documents, the method comprising the steps of:

placing a document containing a visible image formed using a marking medium containing a metal or other material affecting a magnetic field upon a document exposure support;

energizing a coil with a varying electrical signal as the document is proximate thereto;

in response to a signal from the coil generating a signal indicating the presence of metal or said other material in the document;

determining, in response to signals identifying the person ordering the reproduction, if that person is authorized to make or receive a copy of the document and in response to a signal indicating such person to be authorized and the signal indicating the presence of metal or said other material in the document making a reproduction of the confidential document employing a marking medium for forming the visible image of the reproduction with a material that includes metal or said other material.

9. The method of claim 8 and including the steps of generating a second signal indicating the absence of a metal or said other material in the document when the document to be reproduced is non-confidential and does not have its visible information formed with a marking medium containing a metal or said other material and in response to a said second signal making a reproduction of said non-confidential document employing a marking medium for forming the visible image of the reproduction that is not of a metal or said other material that affects a magnetic field.

10. A method for controlling reproduction of confidential documents, the method comprising the steps of:

placing a document containing a visible image formed using a marking medium containing either a first type of material affecting a magnetic field or a second type of material not affecting a magnetic field upon a document exposure support;

energizing a device for detecting a change in the magnetic field signal as the document is proximate thereto; and in response to a signal from the device generating a signal indicating the presence of the first or the second type of material in the document to define whether or not the document is a confidential document;

determining, in response to signals identifying the person ordering the reproduction, if that person is authorized to make or receive a copy of the document; and in response to a signal indicating such person to be authorized and the signal indicating the type of material in the document making a reproduction of the confidential document employing a marking medium for forming the visible image of the reproduction with a material of the type that is formed on the document; and making a reproduction of a non-confidential document employing a marking medium for forming the visible image of the reproduction that is of the type used for reproducing non-confidential documents.

* * * * *